United States Patent [19]

Murphy

[11] Patent Number: 4,735,029

[45] Date of Patent: Apr. 5, 1988

[54] ROOF SYSTEM TRUSS PIN

[75] Inventor: Wesley T. Murphy, Auburn, N.Y.

[73] Assignee: Etco Building Systems, Inc., Auburn, N.Y.

[21] Appl. No.: 880,575

[22] Filed: Jun. 30, 1986

[51] Int. Cl.[4] ..... E04C 3/02

[52] U.S. Cl. ..... 52/693; 52/731

[58] Field of Search ..... 52/690, 693–695, 52/696, 588, 584, 729–731

[56] References Cited

U.S. PATENT DOCUMENTS 1,735,591 11/1929 White ..... 52/695

2,467,558 4/1949 Kapnek ..... 52/695 X

*Primary Examiner*—Carl D. Friedman

*Attorney, Agent, or Firm*—Bruns and Wall

[57] ABSTRACT

A roof system comprises roof support members, such as rafters and purlins, to which truss members are connected. These members are formed as sheet metal beams. The truss members are joined to the other members by spring truss pins or clips. These clips are generally formed as a spring bight having first and second legs, with key portions formed at the free end of the legs. The key portion of the first leg includes an indentation which faces away from the second leg, and a short stub member. The second leg key portion includes an offset which extends transversely in the direction towards the line of the first leg, and a stub member which extends in the direction generally parallel to the second leg.

5 Claims, 1 Drawing Sheet

ROOF SYSTEM TRUSS PIN

BACKGROUND OF THE INVENTION

This invention relates to sheet metal building construction, and is more particularly directed to a roof support system employing sheet metal rafters, purlins, truss members, and the like.

Various approaches have been taken in the fabrication of buildings from sheet metal, and one typical approach is to employ single pieces of sheet metal for the roof structure. Such roof systems are discussed in U.S. Pat. Nos. 3,952,461 and 2,272,910. Rafters and purlins fabricated of sheet metal and suitable for use in supporting the roof of a structure are discussed in U.S. Pat. No. 4,192,119. A metal roof system is discussed in U.S. Pat. No. 4,389,829, and in that system metal rafters, purlins, and trusses are joined with a spring metal truss pin or clip. However, that truss pin requires the truss member to have a bent-over end portion that must be aligned with the rafter or purlin with which it is to be connected. Bending and forming tools are required to form and assemble the trusses onto the rafters or purlins.

OBJECTS AND SUMMARY OF THE INVENTION

Accordingly, it is an object of this invention to provide an improved sheet metal roof support system.

It is a futher object of this invention to provide a sheet metal roof support system that is inexpensive to construct, simple to assemble and install, but does not require special tools.

It is still another object of this invention to provide a sheet metal roof support system that contains structural members that can be joined together by use of a simple clip-type truss pin.

It is an associated object of this invention to provide a truss pin that is simple to employ and inexpensive to fabricate, but which securely couples the truss members to the other roof support members.

The above and other objects of this invention are achieved with a roof support system having metal rafters and corresponding metal purlins that are connected by sheet metal trusses. In a preferred embodiment, the roof support members are formed as I beams having box flanges, and the trusses are formed as channel members that have flange ends that span the outer sides of the box flanges of the metal rafters or purlins.

The truss pin of this invention is a generally U-shaped member having a spring bight with a first leg and second leg aligned generally parallel to each other and joined at their upper ends by a bend. The first leg has a key formed at its free end. The key is formed of an indentation at the free end of the first leg, the indentation facing away from the second leg, and a short stub that extends down from this indentation.

The second leg, which is somewhat longer than the first leg, also has a key formed at its end. The key of the second leg is formed of an offset extending generally laterally in the direction towards the first leg and at its end the key is bent into a stub that continues in the direction parallel to the direction of the second leg.

The truss is joined to the roof support member by fitting the flange extensions of the truss member over the box flange of the roof support member and aligning holes or openings in the truss member flange extension with corresponding holes or openings in the outer walls of the roof support member box flange. The stub of the second key is inserted into these aligned holes, and the clip is then rotated until the lateral offset is disposed within these aligned openings. Then the spring bight of the truss pin or clip is compressed, and the key at the end of the first leg is inserted into an opening on the flange wall of the rafter or purlin box flange. When the clip is released, the indentation part of the first key engages one edge of the associated opening, and pushes the second leg of the spring bight outward, so that the stub of the second key pushes against the sidewall of the rafter member box flange. This holds the pin, the rafter member, and the truss member securely together, until such time as the truss pin or clip is positively removed.

No special tools are required for this installation.

The above and many objects, features, and advantages of this invention will be more fully understood from the ensuing detailed description of a preferred embodiment, which should be considered in connection with the accompanying drawing.

DETAILED DESCRIPTION OF A PREFERRED EMBODIMENT

Figure 1:
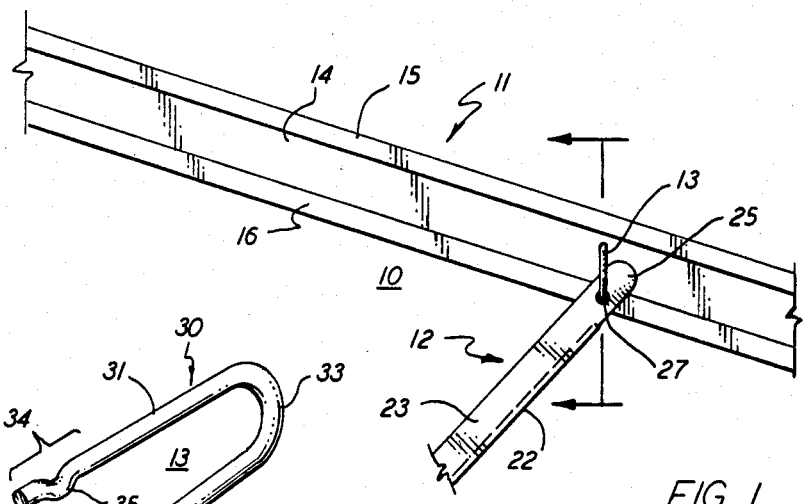
FIG. 1 is a partial side elevation of a roof system employing a roof support member, a truss member, and a truss pin or clip according to an embodiment of this invention.

Referring now to the Drawing figures, FIG. 1 shows a roof support system 10 that employs sheet metal members which are joined together to provide a structurally tight, high strength assembly. The roof support system 10 employs a plurality of rafter members 11, of which only one is shown here, and which are connected to companion purlins (not shown) by means of truss members 12. The truss member 12 is joined to the rafter member 11 by means of a truss pin or clip 13 (better shown in FIG. 2). The other end of the truss member 12, not shown here, would be joined to the associated purlin by means of a similar truss pin or clip 13.

The sheet metal rafter member 11 is generally a beam having a web 14, an upper box flange 15, and a lower box flange 16. The flange 16, as better shown in FIGS. 3–5, has a pair of flange walls 17 extending outward from the web 14, a pair of outer or side walls 18 which extend generally parallel to the web 14, and an outer wall 19 extending transversely between the walls 18.

Figure 3:
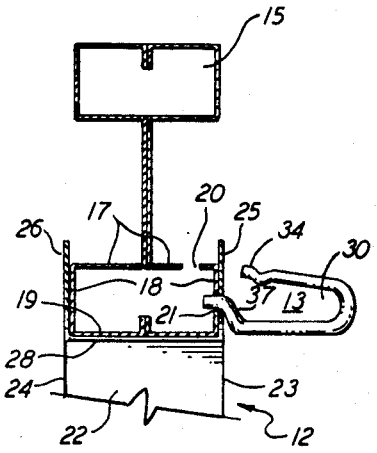
FIGS. 3, 4, and 5 are cross sectional views, taken in the direction indicated in FIG. 1, and these illustrate the installation sequence of the clip into the roof support member and the truss member.
Figure 4:
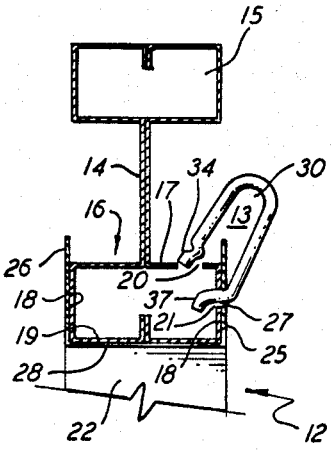
Figure 5:
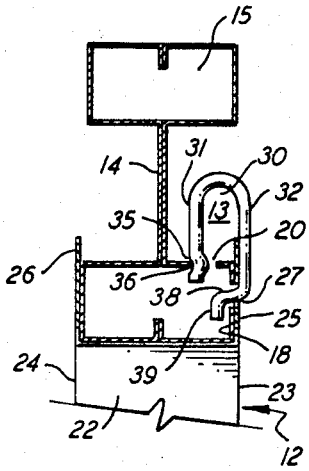

As shown in FIGS. 3–5, there is at least one opening 20 provided in one of the flange walls 17, and at least one opening 21 provided in the associated outer wall 18.

The truss member 12 is generally channel-shaped with a web 22 and side flanges 23 and 24. These flanges have ears or extensions 25 and 26, respectively, which span the box flange 16 of the rafter member 11, and fit against the outer side walls 18. At least one of these extensions 25, 26 has an opening 27 which is in registry with the opening 21 on the box flange outer wall 18 when the truss member 12 and the rafter member 11 are properly positioned. Then an end 28 of the truss member web 22 abuts the wall 19 of the box flange 16, and supports the load of the rafter member 11.

Figure 2:
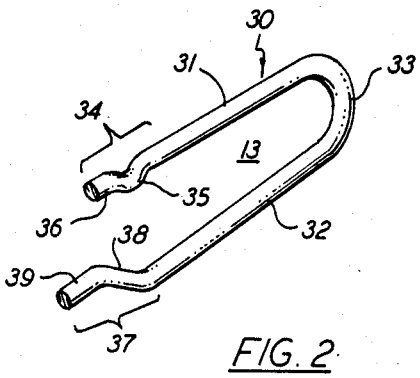
FIG. 2 is an enlarged perspective view of the truss pin shown in FIG. 1, with the pin in an unstressed or free condition.

As shown in FIG. 2, the truss pin 13 of this embodiment is generally formed as a U-shaped spring member 30, formed as a spring bight having a first leg 31 and a second leg 32 generally parallel to the first leg but slightly longer than the first leg 31. These legs 31 and 32 are joined at one end by a bend 33. The bend 33 is situated at the upper end in the installed position as shown in FIGS. 1 and 5.

A key 34 is formed at the free end of the first leg 31. This key 34 has a semi-circular indentation or half loop 35, which is indented on the side away from the second leg 32. A straight stub 36 continues from the end of the indentation 35 in the same line as the first leg 31.

A second key 37 is formed at the free end of the second leg 32. This key 37 consists of an offset 38 or laterally bent portion, which extends generally laterally or transversely across towards the line of the first leg 31. A straight stub 39 bends from the end of the offset 38, and continues in the direction generally parallel to the second leg 32.

The truss pin or clip 13 is favorably formed of a strong, resilient and durable material. This can be formed of a spring wire, such as spring steel. Preferably, all of the portions of the truss pin 13 lie in a single plane.

The installation of the truss member 12, rafter mewmber 11, and truss pin or clip 13 can be easily explained, as follows, with reference to FIGS. 3, 4, and 5.

Initially, the end of the truss member 12 is fit over the box flange 16 of the roof rafter member 11 (or purlin) and the opening 27 is brought into registry with the opening 21. Then, the stub 39 of the second key 37 of the truss pin 13 is inserted into these aligned openings 20 and 21, as shown in FIG. 3. The pin is rotated upwards, as shown in FIG. 4, and the spring bight 30 is compressed by finger pressure or the like. Then, the key 34 is inserted into the opening 20 in the flange wall 17. Rotation of the truss pin 13 is continued until the stub 36 is entirely through the opening 20. Then, the pressure is released from the spring bight 31, and the indentation 35 lodges against the web side of the opening 20. The second leg 32 of the pin 13 is urged outwards until the stub 39 of the second key 37 is biased against the inside of the outer box flange wall 18.

As can be seen here, the lateral extent of the offset 38 is sufficient for clearance through both the wall 18 and the flange extension 25.

The first and second legs 31 and 32 are angled slightly apart when the pin or clip 13 is in an unstressed state, as shown in FIG. 2. When the truss pin or clip 13 is in place as shown in FIG. 5, the legs 31 and 32 remain pressed somewhat together so that they are generally parallel.

As should be evident from this description, the arrangement comprising the truss members 12, the rafter members 11 (or corresponding purlins) and the truss pins or clips 13 permit the roof structure to be quickly and accurately set up with the rafters and purlins aligned properly regardless of the angular displacement between the members. Once assembled, the truss pins 13 of the type herein described securely join the roof supporting structure into a stable, high strength unit.

Also, while the truss pin 13, truss member 12, and rafter 11 are shown in one orientation, that is required only for illustration here, for the elements of this invention can be arranged to equal advantage in any arbitrary orientation.

While this invention has been described hereinabove with reference to a specific preferred embodiment, it should be recognized that the invention is not limited to that precise embodiment, and that many modifications and variations thereof would be apparent to those skilled in the art without departure from the scope and spirit of this invention, as defined in the appended claims.

I claim:

1. A metal roof support structured assembly that comprises at least one metal rafter member, at least one metal truss member, and a truss pin connecting one end of the truss member to an intermediate part of the rafter member; said metal rafter member being formed as a beam having a web and a box flange, said box flange having outer walls parallel to the web with openings in at least one of the outer walls and flange walls extending from the web to the outer walls, with openings in at least one of the flange walls corresponding to the openings in at least one outer wall; said metal truss member-being formed as a beam having a pair of parallel flanges with flange ends at said one end of the truss member, the flange ends defining an open space therebetween to span across said rafter member box flange, at least one of said flange ends having an opening corresponding to the outer wall opening of said rafter member; and said truss pin being formed as a spring clip formed of a single piece of high strength resilient material, including a spring bight portion having first and second generally parallel legs joined at upper ends thereof by a bend, the free end of the second leg extending beyond the free end of the first leg, a first key formed at the free end of said first leg and including an indentation at the side away from the second leg and an end stub adjoining said indentation, said first key fitting into said rafter member flange wall opening with said indentation biased against one side of the opening and a second key formed at the free end of said second leg and including an offset extending from the second leg free end laterally through said rafter member outer wall opening and said truss member flange end opening when such openings are in registry, and an end stub at the end of said offset extending generally parallel with said second leg, and biased against an inner surface of the rafter member box flange outer wall.

2. The metal roof support structure of claim 1 wherein said rafter member and said truss member are formed of sheet steel.

3. The metal roof support structure of claim 1 wherein said truss pin is formed of a single piece of spring steel.

4. The metal roof support structure of claim 1 wherein said truss pin is formed of a single length of spring wire.

5. The metal roof support structure of claim 1 wherein said truss pin spring clip lies generally in a single plane.

* * * * *